US007593663B2

(12) United States Patent
Nogami

(10) Patent No.: US 7,593,663 B2
(45) Date of Patent: Sep. 22, 2009

(54) IMAGE FORMING APPARATUS

(75) Inventor: Hidekazu Nogami, Aichi (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 181 days.

(21) Appl. No.: 11/924,995

(22) Filed: Oct. 26, 2007

(65) Prior Publication Data

US 2008/0101816 A1 May 1, 2008

(30) Foreign Application Priority Data

Oct. 27, 2006 (JP) ..... 2006-293089

(51) Int. Cl.
*G03G 21/20* (2006.01)

(52) U.S. Cl. ..... 399/92; 399/111

(58) Field of Classification Search ..... 399/91, 399/92, 107, 110, 111, 113, 116
See application file for complete search history.

(56) References Cited

U.S. PATENT DOCUMENTS 4,470,689 A * 9/1984 Nomura et al. ..... 399/114
5,038,174 A * 8/1991 Kato et al. ..... 399/92
2005/0220479 A1 10/2005 Ito et al.

FOREIGN PATENT DOCUMENTS

JP 2005-292356 10/2005

* cited by examiner

*Primary Examiner*—Hoan H Tran
(74) *Attorney, Agent, or Firm*—Banner & Witcoff, Ltd.

(57) ABSTRACT

An image forming apparatus includes: a photosensitive element; a charger for electrically charging the photosensitive element; an exposure device for scanning laser light across the photosensitive element that has been electrically charged by the charger; an exposure window positioned away from the exposure device for a predetermined distance and through which the laser light passes; and an exhaust fan for drawing air between the exposure device and the exposure window toward the charger and discharging the air from the image forming apparatus. The exposure window is defined by a plurality of walls, in which a first wall that is the farthest wall from the charger and a second wall that is the nearest wall from the charger satisfy a formula: A<B, where A is a distance between the first wall and the exposure device, and B is a distance between the second wall and the exposure device.

9 Claims, 2 Drawing Sheets

IMAGE FORMING APPARATUS

CROSS REFERENCE TO RELATED APPLICATIONS

This application claims the foreign priority benefit under Title 35, United States Code, §119(a)-(d) of Japanese Patent Application No. 2006-293089 filed on Oct. 27, 2006 in the Japan Patent Office, the disclosure of which is herein incorporated by reference in its entirety.

BACKGROUND OF THE INVENTION

The present invention relates to an image forming apparatus equipped with a charger for electrically charging a photosensitive element and an exhaust fan for ventilating the image forming apparatus.

Generally, a known image forming apparatus electrically charges a photosensitive drum and emits laser light on this electrically charged photosensitive drum so that the electric potential of the exposed area (i.e., area on which the laser light is emitted) lowers to form an electrostatic latent image on the photosensitive drum. The image forming apparatus then supplies developer on this latent image to form a developer image, which is transferred on a paper so that a predetermined image is formed on the paper.

As one example of such an image forming apparatus, Japanese Laid-open Patent Application No. 2005-292356, which corresponds to US 2005/0220479A1, discloses an image forming apparatus equipped with a scanner unit for scanning laser light and a process unit positioned below the scanner unit with a predetermined gap interposed therebetween. This image forming apparatus mainly includes in the process unit a photosensitive drum for carrying developer images, a charger for electrically charging the photosensitive drum, and an exposure window through which laser light from the scanner unit is emitted on to the photosensitive drum. The charger and the exposure window are arranged adjacent to each other.

This kind of image forming apparatus is usually provided with an exhaust fan for mainly discharging heat from the inside of the apparatus. Air between the scanner unit and the process unit is drawn by the exhaust fan from the exposure window toward the charger so as to perform a heat discharging operation, etc.

However, when the exhaust fan draws air between the scanner unit and the process unit, there may be a possibility that air flows into the process unit through the exposure window, etc. and then flows out from the process unit through the charger. If this happens, contrary to ion flow generated during the electric charge by the charger (i.e., airflow generated by the movement of ions upon electric charge) and directed from the charger to the photosensitive drum, the operation of the exhaust fan generates airflow which flows in the counter direction of the ion flow. As a result, efficiency of electric charge may be decreased by this counter flow.

In view of the foregoing drawback of the conventional image forming apparatus, the present invention seeks to provide an image forming apparatus which can prevent a decrease in efficiency of electric charge.

SUMMARY OF THE INVENTION

According to the present invention, there is provided an image forming apparatus comprising: a photosensitive element; a charger for electrically charging the photosensitive element; an exposure device for scanning laser light across the photosensitive element that has been electrically charged by the charger; an exposure window positioned away from the exposure device for a predetermined distance and through which the laser light passes; and an exhaust fan for drawing air between the exposure device and the exposure window toward the charger and discharging the air from the image forming apparatus. The exposure window is defined by a plurality of walls, in which a first wall that is the farthest wall from the charger and a second wall that is the nearest wall from the charger satisfy a formula: $A<B$, where A is a distance between the first wall and the exposure device, and B is a distance between the second wall and the exposure device.

With this configuration of the image forming apparatus, the exposure window is defined by a plurality of walls including a first wall that is the farthest wall from the charger and a second wall that is the nearest wall from the charger, and the distance A between the first wall and the exposure device and the distance B between the second wall and the exposure device satisfy the formula: $A<B$. Therefore, the flow velocity of the airflow flowing through a space between the first wall and the exposure device is higher than the flow velocity of the airflow flowing through a space between the second wall and the exposure device. This makes it possible to restrict the amount of air flowing into the process unit through the exposure window, so that an occurrence of the counter airflow flowing in the opposite direction of the ion flow that is generated upon electric charge by the charger can be restricted. As a result, it is possible to restrict a decrease in the efficiency of electric charge.

BRIEF DESCRIPTION OF THE DRAWINGS

Other objects and aspects of the present invention will become more apparent by describing in detail illustrative, non-limiting embodiments thereof with reference to the accompanying drawings, in which.

DETAILED DESCRIPTION OF THE INVENTION

Figure 1:
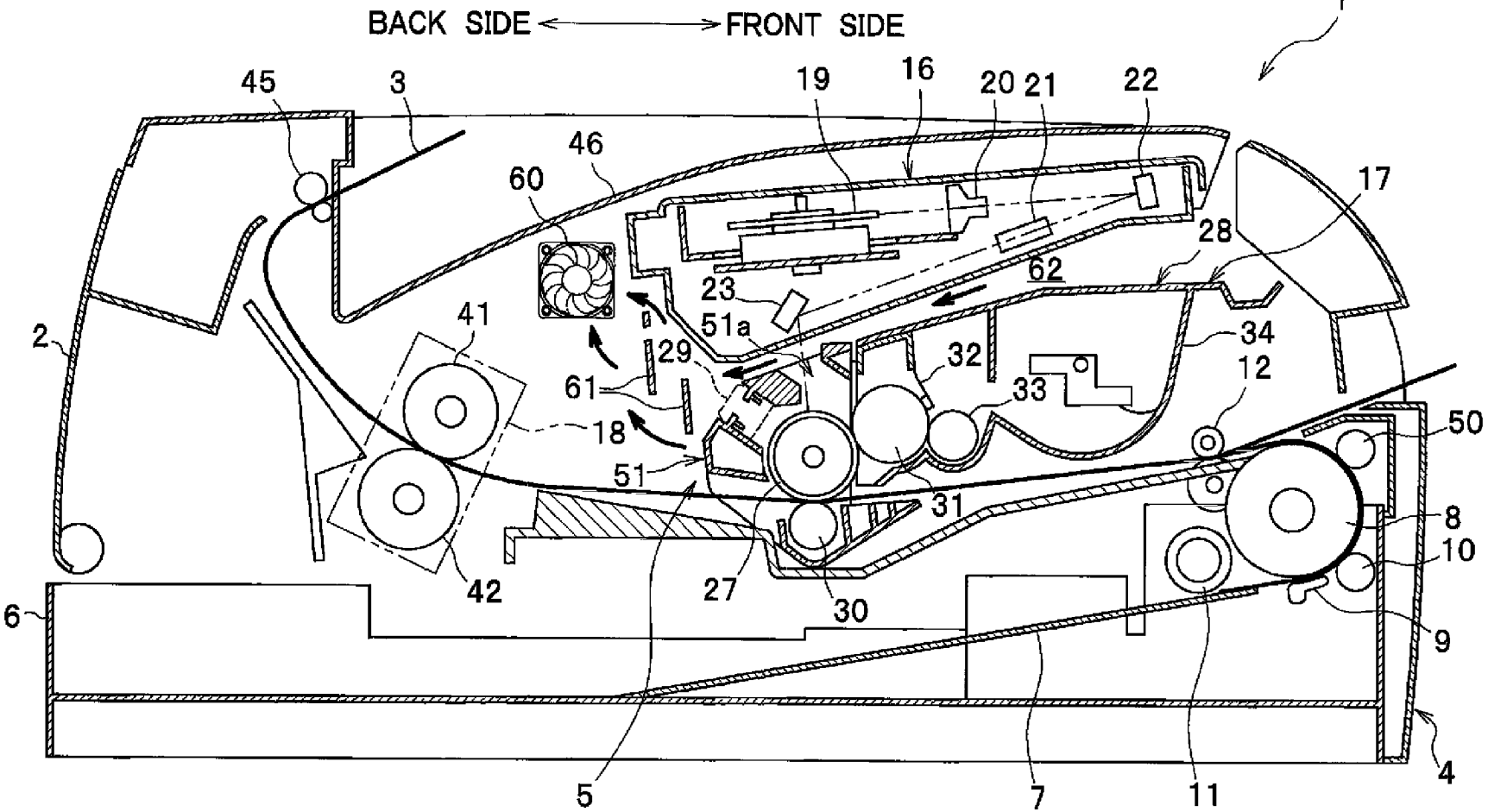
FIG. 1 is a side sectional view illustrating a laser printer as one example of an image forming apparatus according to the present invention.

With reference to FIG. 1, brief description will be given on the overall structure of a laser printer as one example of an image forming apparatus according to the present invention.

Overall Structure of Laser Printer

As seen in FIG. 1, a laser printer 1 includes a main body casing 2, and provided in the main body casing 2 are a feeder unit 4 for feeding papers 3, an image forming unit 5 for forming an image on a paper 3 to be fed from the feeder unit 4, etc. In the following description, unless otherwise stated, the right side of FIG. 1 is referred to as a "front or near side" and the left side of FIG. 1 is referred to as a "back or far side", based on the directions where the user stands in front of the laser printer 1 and looks at the same upon using the laser printer 1.

Structure of Feeder Unit

The feeder unit 4 includes a paper feed tray 6 slidable into and detachable from a bottom space provided in the main body casing 2, and a paper lifting plate 7 provided in the paper feed tray 6. The feeder unit 4 further includes a pick-up roller 11 provided above the paper feed tray 6 at one end side thereof, a feed roller 8 positioned downstream of the pick-up roller 11 as seen in the conveying direction of papers 3, a paper feed pad 9, a pinch roller 10, and a cleaning roller 50 for removing paper dust. Further, a paper stop roller 12 is provided in the feeder unit 4 at a position downstream of the cleaning roller 50.

According to this feeder unit 4, the paper lifting plate 7 collects papers 3 in the paper feed tray 6 toward the pick-up roller 11. The pick-up roller 11 then picks up and feeds out a paper 3 between the feed roller 8 and the paper feed pad 9 at which the paper 3 is fed out on a one-by-one basis. The paper 3 then passes the rollers 10, 50, 12 and is conveyed to the image forming unit 5.

Structure of Image Forming Unit

The image forming unit 5 includes a scanner unit 16 as one example of an exposure device, a process cartridge 17, a fixing unit 18, etc.

Structure of Scanner Unit

The scanner unit 16 is provided at an upper part of the main body casing 2. The scanner unit 16 includes a laser light emitting device (not shown), a rotatable polygon mirror 19, a plurality of lenses 20, 21, and reflecting mirrors 22, 23. A laser beam is emitted from a laser light emitting device based on image data. As shown by the chain line of FIG. 1, the laser beam emitted from the laser light emitting device passes in order through or is reflected at the polygon mirror 19, the lens 20, the reflecting mirror 22, the lens 21, and the reflecting mirror 23, and thereafter it is irradiated onto the photosensitive drum 27 of the process cartridge 17 by high speed scanning.

Structure of Process Cartridge

The process cartridge 17 is arranged below the scanner unit 16 with a predetermined gap interposed therebetween. The process cartridge 17 is attached to and detachable from the main body casing 2. The process cartridge 17 mainly consists of a developer cartridge 28 and a drum unit 51.

The developer cartridge 28 is attached to and detachable from the drum unit 51, and includes a development roller 31, a doctor blade 32, a supply roller 33, and a toner hopper 34. Toner stored in the toner hopper 34 is supplied to the development roller 31 by the supply roller 33, during which the toner charges positively due to frictional contact between the supply roller 33 and the development roller 31. When the development roller 31 rotates, the toner deposited on the development roller 31 passes through a space between the doctor blade 32 and the development roller 31, so that the toner is carried on the development roller 31 as a thin layered toner having a constant thickness.

The drum unit 51 mainly includes a photosensitive drum 27 as one example of the photosensitive element, a Scorotron charger 29 as one example of the charger, and a transfer roller 30.

The photosensitive drum 27 is rotatably supported in the housing of the drum unit 51. The photosensitive drum 27 has a drum main body to be earthed, and the surface of the photosensitive drum 27 is made of a photosensitive layer to be charged positively. An exposure window 51*a* is arranged above the photosensitive drum 27. The exposure window 51*a* is provided as an opening formed in the housing of the drum unit 51.

The Scorotron charger 29 is positioned away from the photosensitive drum 27 with a predetermined gap interposed therebetween. To be more specific, the Scorotron charger 29 is positioned diagonally upward from the photosensitive drum 27 (i.e., backward and upward from the photosensitive drum 27) facing to the photosensitive drum 27. The Scorotron charger 29 (hereinafter referred to as the "charger 29") is a Scorotron-type charger having a charging wire made of tungsten or the like for producing corona discharge and configured to electrically charge the surface of the photosensitive drum 27 uniformly in the plus polarity. Ion flow is generated in the charger 29 due to corona discharge. The ion flow flows in the direction from the charger 29 to the photosensitive drum 27.

The transfer roller 30 is rotatably supported in the housing of the drum unit 51 at a position under the photosensitive drum 27 and opposed to and in contact with the photosensitive drum 27. The transfer roller 30 has a metallic roller shaft covered with a conductive rubber material. During the transfer process, a transfer bias is applied to the transfer roller 30 under constant current control.

In operation, the surface of the photosensitive drum 27 is uniformly charged to the plus polarity by the charger 29, and thereafter exposed to the laser beam from the scanner unit 16 by high speed scanning. This exposure process lowers the potential of the exposed surface on the photosensitive drum 27, thereby forming an electrostatic latent image based on the image data. The term "electrostatic latent image" indicates an invisible image produced on the uniformly positively charged surface of the photosensitive drum 27 with the exposed area made lower in potential by exposure to the laser beam. Next, as the development roller 31 rotates, toner deposited on the development roller 31 comes into contact with the opposed photosensitive drum 27 so that the toner is supplied to the electrostatic latent image formed on the photosensitive drum 27. The toner is selectively retained on the photosensitive drum 27 solely in the area corresponding to the electrostatic latent image, so as to visualize the latent image. This reversal development forms a toner image on the photosensitive drum 27.

Thereafter, the photosensitive drum 27 and the transfer roller 30 rotate so that the paper 3 is held and fed forward between the rollers 27, 30, during which the toner image formed on the surface of the photosensitive drum 27 is transferred to the paper 3.

Structure of Fixing Unit

The fixing unit 18 is positioned downstream of the process cartridge 17, and includes a heating roller 41, and a pressure roller 42 opposed to and pressing the heating roller 41. In the fixing unit 18 as constructed above, the toner image transferred onto the paper 3 is fixed by heating and fusing the toner while the paper 3 passes between the heating roller 41 and the pressure roller 42. The paper 3 that has been fixed by heating and fusing at the fixing unit 18 is conveyed to a paper output roller 45 positioned downstream of the fixing unit 18, and thereafter discharged from the paper output roller 45 onto a paper output tray 46.

In order to exhaust heat in the laser printer 1, an exhaust fan 60 is provided between the fixing unit 18 and the scanner unit 16. Provided below the exhaust fan 60 and between the fixing unit 18 and the process cartridge 17 is a duct 61 for rectifying and regulating a flow of air.

By this arrangement of the exhaust fan 60 and the duct 61, when the exhaust fan 60 is operated, the exhaust fan 60 sucks air between the drum unit 51 and the fixing unit 18 directly or through the duct 61 and discharges the air to the outside. The exhaust fan 60 also sucks air from the front upper side of the laser printer 1 through a passage formed between the scanner unit 16 and the process cartridge 17, that is an airway 62 extending in the longitudinal direction of the laser printer 1, and then discharges the air to the outside. Structure around the airway 62 will be described below in detail.

Structure Around Airway

Figure 2:
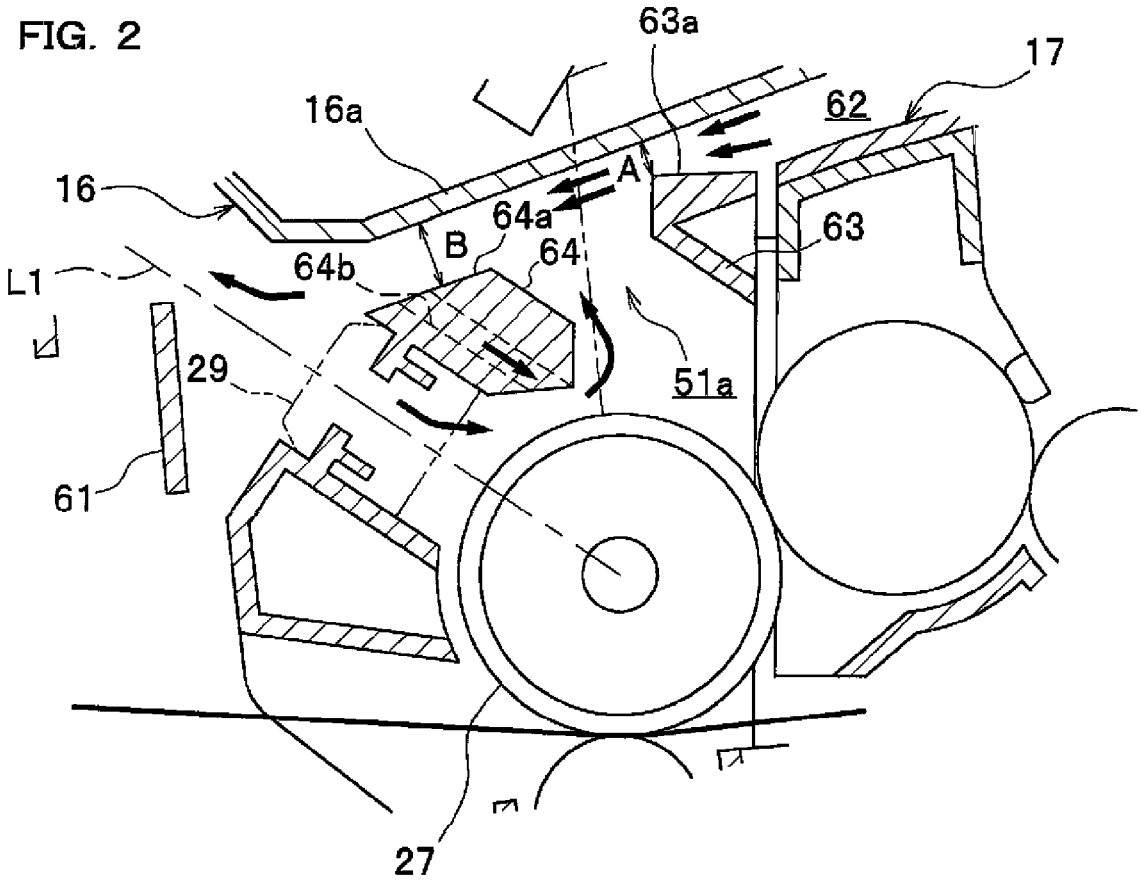
FIG. 2 is an enlarged sectional view showing the structure around a longitudinal airway defined in the laser printer.

As seen in FIG. 2, the scanner unit 16 by which the upper wall of the airway 62 is defined is arranged in a position not across (i.e., offset from) the extension L1 extending from the line connecting the center of the photosensitive drum 27 and the center of the charger 29. Further, as shown in FIG. 1, the photosensitive drum 27, the charger 29, and the exhaust fan 60 are arranged in line. Furthermore, the duct 61 is provided at a position opposed to the outlet of the airway 62. By this arrangement of the parts, the flow direction of the airflow coming from the exposure window 51*a* and flowing toward the charger 29 is bent around the charger 29 in a direction away from the photosensitive drum 27.

Back side of the airway 62 comprises a scanner plate 16*a* by which the lower wall of the scanner unit 16 is defined, and a first wall 63 and a second wall 64 which form the exposure window 51*a*. The first wall 63 is a wall that is positioned farthest from the charger 29, and the second wall 64 is a wall that is positioned nearest from the charger 29. The charger 29 is adjacent to the second wall 64 and positioned behind the second wall 64, i.e., downstream of the second wall 64 as seen in the flow direction of air. The second wall 64 has a plurality of openings 64*b* with a predetermined pitch in the right and left direction (i.e., direction orthogonal to the drawing plane). Further, the first wall 63 and the second wall 64 are arranged such that the distance between the first and second walls 63, 64 is in the range from 5 to 30 mm.

The first wall 63 is provided with a projection 63*a* which protrudes upward relative to the upper surface 64*a* of the second wall 64, so that the airway 62 is restricted at the projection 63*a*. To be more specific, the distance A between the first wall 63 and the scanner plate 16*a* in the direction orthogonal to the scanner plate 16*a* and the distance B between the second wall 64 and the scanner plate 16*a* satisfy the following formulae:

$$A<B \quad (1)$$

$$A/B<0.8 \quad (2)$$

Next, the influence of the projection 63*a* provided in the airway 62 will be described.

As shown in FIG. 1, when the exhaust fan 60 is operated, the exhaust fan 60 sucks air from the front upper side of the laser printer 1 through the longitudinal airway 62 so that air flows in the airway 62 toward the back side of the laser printer 1. As shown in FIG. 2, when the air passes through the space defined by the projection 63*a* of the first wall 63 and the scanner plate 16*a*, the flow velocity of the air is increased because the sectional area of the airway 62 is restricted at the projection 63*a*. As a result, most of the air flows in the airway 62 without flowing into the process cartridge 17 through the exposure window 51*a*, and then flows upward away from the charger 29.

In other words, the airflow passing along the projection 63*a* of the first wall 63 has a higher flow velocity than the airflow passing along the second wall 64, so that pressure is reduced at the downstream side of the first wall 63 (i.e., upper space of the exposure window 51*a*) than at the downstream side of the second wall 64 (i.e., upper space of the charger 29). Therefore, air at the upper side of the charger 29 is drawn and flows into the charger 29 and the process cartridge 17 and flows out from the process cartridge 17 through the exposure window 51*a*. This makes it possible to restrict an occurrence of the counter airflow flowing from the inside to the outside of the process cartridge 17 through the charger 29. Thereafter, the flow of air is bent around the charger 29 in a diagonally upward direction toward the exhaust fan 60 and away from the photosensitive drum 27, and then flows out to the outside from the exhaust fan 60.

According to the laser printer 1 as constructed above, the following advantages can be obtained.

(1) The flow velocity increases when airflow passes through the restriction defined by the projection 63*a*, so that the amount of air flowing into the process cartridge 17 through the exposure window 51*a* can be decreased. It is possible to restrict an occurrence of the counter airflow flowing in the opposite direction of the ion flow that is generated upon electric charge by the charger 29, thereby restricting a decrease in the efficiency of electric charge.

(2) The distance A and the distance B have a relation to satisfy the formula (2) defined by A/B<0.8, so that airflow flowing through the space between the second wall 64 and the photosensitive drum 27 flows in the direction away from the charger 29 (i.e., direction toward the front side of the laser printer 1). It is possible to reliably restrict a decrease in the efficiency of electric charge. The flow direction of the airflow between the second wall 64 and the photosensitive drum 27 was proved by experiments carried out by the inventor. See Example to be described later.

(3) Since the distance from the first wall 63 to the second wall 64 is in the range from 5 to 30 mm, the opening area of the exposure window 51*a* becomes relatively small. This makes it possible to restrict air from flowing into the process cartridge 17 through the exposure window 51*a* while reliably guiding laser light from the scanner unit 16 to the photosensitive drum 27.

The present invention is not limited to the above specific embodiment, and various changes and modifications may be made without departing from the scope of the attached claims.

According to the above preferred embodiment, the projection 63*a* is provided on the first wall 63. However, a projection may be provided on the bottom wall of the scanner plate 16*a* opposed to the first wall 63, or a projection may be provided both on the scanner plate 16*a* and the first wall 63.

Although the present invention has been described as being applied to a laser printer, the present invention is applicable to other image forming apparatus such as a copying machine and a multifunction device.

Example

One example for the above preferred embodiment will be described below. More specifically, experimental results (simulation results) are shown for relations between ratio A/B of the distance A to the distance B and flow rate of air at predetermined points.

Figure 3:
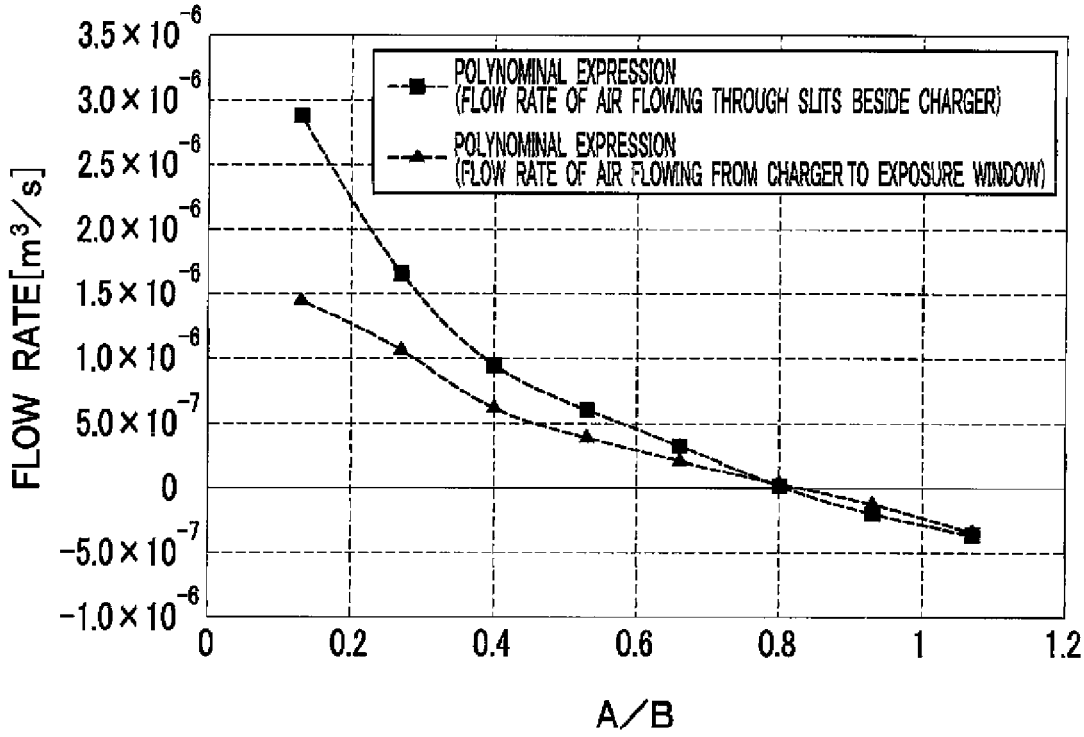
FIG. 3 is a graph explaining relations between ratio A/B of distances A and B and flow rate at predetermined points.

In the experiments (simulations) according to this example, the exhaust fan 60, the charger 29, the exposure window 51*a*, the first wall 63, the second wall 64, etc. are arranged as described above in the preferred embodiment. To be more specific, arrangements of the parts are the same as those of HL-2040 model laser printer manufactured by Brother Industries, Ltd. except for the height of the projection 63*a* provided on the first wall 63. The flow rate of air discharged by the exhaust fan 60 is $4.25\times10^{-6}$ $m^3/s$. While maintaining these conditions, the height of the projection 63*a* on the first wall 63 is changed in accordance with the TABLE 1 below, and measurements are made for the flow rate of air flowing through the openings 64*b* formed in the second wall 64 and the flow rate of air flowing through a space between the second wall 64 and the photosensitive drum 27. Accordingly, the experimental results as shown in TABLE 1 and FIG. 3 were obtained. Plus-minus signs (plus sign is omitted) found in TABLE 1 at columns indicating flow rate are determined such that plus sign is used for the flow rate of air flowing through the openings 64*b* of the second wall 64 in the direction from the outside to the inside of the process cartridge 17 and that plus sign is used for the flow rate of air flowing through the space between the second wall 64 and the photosensitive drum 27 in the direction from the charger 29 to the exposure window 51*a*.

TABLE 1

| A/B | Flow rate of air flowing through openings of second wall ($m^3/s$) | Flow rate of air flowing through a space between second wall and photosensitive drum ($m^3/s$) |
|---|---|---|
| 1.07 | $-3.54 \times 10^{-7}$ | $-3.43 \times 10^{-7}$ |
| 0.93 | $-1.98 \times 10^{-7}$ | $-1.25 \times 10^{-7}$ |
| 0.80 | $1.57 \times 10^{-8}$ | $3.26 \times 10^{-8}$ |
| 0.66 | $3.28 \times 10^{-7}$ | $2.08 \times 10^{-7}$ |
| 0.53 | $6.05 \times 10^{-7}$ | $3.91 \times 10^{-7}$ |
| 0.40 | $9.49 \times 10^{-7}$ | $6.18 \times 10^{-7}$ |
| 0.27 | $1.66 \times 10^{-6}$ | $1.06 \times 10^{-6}$ |
| 0.13 | $2.88 \times 10^{-6}$ | $1.44 \times 10^{-6}$ |

According to this example, when the ratio of the distance A to the distance B is set to satisfy A/B<0.8, it is proved that air flowing through the space between the second wall 64 and the photosensitive drum 27 is directed to the direction from the charger 29 to the exposure window 51*a*. Also, when the condition A/B<0.8 is satisfied, it is proved that air flowing through the openings 64*b* of the second wall 64 is directed to the direction from the outside to the inside of the process cartridge 17 and that a counter flow of air does not occur, which flows into the process cartridge 17 through the exposure window 51*a* and flows out from the openings 64*b* of the second wall 64. As described above, when the condition A/B<0.8 is satisfied, it is proved that ion flow generated upon electric charge by the charger 29 is hardly interrupted by other airflow and a smooth and favorable flow of the ion flow can be obtained.

On the contrary, when A/B is 0.93 or 1.07, it is proved that air flowing through the space between the second wall 64 and the photosensitive drum 27 is directed to the direction from the exposure window 51*a* to the charger 29 and that air flowing through the openings 64*b* of the second wall 64 is directed to the direction from the inside to the outside of the process cartridge 17. However, when compared with the results between the conditions of A/B is 0.93 and A/B is 1.07, it is proved that the flow rate of air is smaller when A/B is 0.93. Accordingly, it is proved that the smaller is the ratio A/B, the more can be restricted for the flow of air interrupting the electric charge by the charge 29. Therefore, when the condition A<B is satisfied, it is proved that ion flow generated upon electric charge by the charger 29 is not likely to be interrupted by other airflow.

What is claimed is:

1. An image forming apparatus comprising:

a photosensitive element;

a charger for electrically charging the photosensitive element;

an exposure device for scanning laser light across the photosensitive element that has been electrically charged by the charger;

an exposure window positioned away from the exposure device for a predetermined distance and through which the laser light passes; and an exhaust fan for drawing air between the exposure device and the exposure window toward the charger and discharging the air from the image forming apparatus, wherein the exposure window is defined by a plurality of walls, in which a first wall that is the farthest wall from the charger and a second wall that is the nearest wall from the charger satisfy a formula: A<B, where A is a distance between the first wall and the exposure device, and B is a distance between the second wall and the exposure device.

2. An image forming apparatus according to claim 1, wherein the exposure device is arranged in a position not across an extension extending from a line connecting a center of the photosensitive element and a center of the charger.

3. An image forming apparatus according to claim 1, wherein the charger is of a corona discharge-type.

4. An image forming apparatus according to claim 1, wherein the photosensitive element, the charger, and the exhaust fan are arranged in line.

5. An image forming apparatus according to claim 1, wherein a flow direction of airflow coming from the exposure window is bent around the charger in a direction away from the photosensitive element.

6. An image forming apparatus according to claim 1, wherein an airway for flowing the air is formed in a longitudinal direction of the image forming apparatus between the exposure device and a drum unit which supports the photosensitive element and the charger, and wherein a flow rectifying duct is provided at a position opposed to an outlet of the airway such that a flow direction of airflow coming from the exposure window is bent around the charger in a direction away from the photosensitive element.

7. An image forming apparatus according to claim 1, wherein the distance A and the distance B satisfy a formula: A/B<0.8.

8. An image forming apparatus according to claim 1, wherein a distance from the first wall to the second wall is in a range from 5 to 30 mm.

9. An image forming apparatus according to claim 1, wherein a projection is formed at least one of on the first wall and on a wall surface of the exposure device which is opposed to the first wall so that an airflow passage is restricted.

* * * * *